US012357025B2

(12) United States Patent
Potter et al.

(10) Patent No.: US 12,357,025 B2
(45) Date of Patent: Jul. 15, 2025

(54) AEROSOL SOURCE FOR A VAPOR PROVISION SYSTEM

(71) Applicant: NICOVENTURES TRADING LIMITED, London (GB)

(72) Inventors: Mark Potter, London (GB); Wade Tipton, London (GB); William Harris, London (GB); Christopher Rowe, London (GB); James Davies, London (GB); James Boonzaier, London (GB); Conor Devine, London (GB)

(73) Assignee: NICOVENTURES TRADING LIMITED, London (GB)

( * ) Notice: Subject to any disclaimer, the term of this patent is extended or adjusted under 35 U.S.C. 154(b) by 1208 days.

(21) Appl. No.: 15/733,408

(22) PCT Filed: Jan. 23, 2019

(86) PCT No.: PCT/GB2019/050187
§ 371 (c)(1),
(2) Date: Jul. 22, 2020

(87) PCT Pub. No.: WO2019/145710
PCT Pub. Date: Aug. 1, 2019

(65) Prior Publication Data

US 2021/0093006 A1 Apr. 1, 2021

(30) Foreign Application Priority Data

Jan. 24, 2018 (GB) ..... 1801146

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/42* (2020.01); *A24F 40/485* (2020.01); *A24F 40/10* (2020.01)

(58) Field of Classification Search
CPC ..... A24F 40/44; A24F 40/485; A24F 40/42; A24F 40/10
See application file for complete search history.

(56) References Cited

U.S. PATENT DOCUMENTS 6,196,218 B1 3/2001 Wiser et al.
8,061,361 B2 11/2011 Maeder et al.
(Continued)

FOREIGN PATENT DOCUMENTS

CN 1631013 A 6/2005
CN 1633780 A 6/2005
(Continued)

OTHER PUBLICATIONS

Communication pursuant to Article 94(3) EPC for Application No. 18715070.1, mailed on Nov. 2, 2020, 21 pages.
(Continued)

*Primary Examiner* — Michael H. Wilson
*Assistant Examiner* — Daniel Edward Vakili
(74) *Attorney, Agent, or Firm* — Merchant & Gould P.C.

(57) ABSTRACT

An aerosol source for a vapor provision system includes a vapor generating element; a reservoir for holding source liquid, the reservoir being bounded by a wall having an opening therein; and a liquid transport element for delivering liquid from the reservoir to the vapor generating element, the liquid transport element having at least one end part inserted into the opening, the end part having a flared portion arranged in contact with the wall of the reservoir to provide a seal for the opening.

18 Claims, 5 Drawing Sheets

(51) Int. Cl.
*A24F 40/42* (2020.01)
*A24F 40/485* (2020.01)

(56) References Cited

U.S. PATENT DOCUMENTS

| | | | |
|---|---|---|---|
| 9,254,007 | B2 | 2/2016 | Morikawa et al. |
| 9,642,167 | B1 | 5/2017 | Cameron |
| 10,097,387 | B1 | 10/2018 | Baker et al. |
| 10,258,087 | B2 | 4/2019 | Kane |
| 10,349,675 | B2 | 7/2019 | Baker et al. |
| 11,213,638 | B2 | 1/2022 | Talbot et al. |
| 11,388,931 | B2 | 7/2022 | Potter et al. |
| 11,510,040 | B2 | 11/2022 | Snyder et al. |
| 11,653,701 | B2 | 5/2023 | Simpson et al. |
| 2004/0047319 | A1 | 3/2004 | Choukroun et al. |
| 2005/0117066 | A1 | 6/2005 | Nettenstrom et al. |
| 2011/0005535 | A1 | 1/2011 | Kersey et al. |
| 2011/0021142 | A1 | 1/2011 | Elg |
| 2011/0265806 | A1 | 11/2011 | Kamijo |
| 2012/0196534 | A1 | 8/2012 | Xiu |
| 2013/0065584 | A1 | 3/2013 | Desai et al. |
| 2013/0081642 | A1 | 4/2013 | Alarcon et al. |
| 2013/0087160 | A1 | 4/2013 | Gherghe |
| 2013/0178160 | A1 | 7/2013 | Kasslin et al. |
| 2013/0228191 | A1 | 9/2013 | Newton |
| 2013/0263869 | A1 | 10/2013 | Lyon et al. |
| 2013/0276799 | A1 | 10/2013 | Safari |
| 2013/0284192 | A1 | 10/2013 | Wang |
| 2013/0306065 | A1 | 11/2013 | Thorens et al. |
| 2013/0340775 | A1 | 12/2013 | Zhu |
| 2014/0020697 | A1 | 1/2014 | Davidson et al. |
| 2014/0060528 | A1 | 3/2014 | Peleg et al. |
| 2014/0107815 | A1 | 4/2014 | Juster et al. |
| 2014/0123989 | A1 | 5/2014 | Liu |
| 2014/0130816 | A1 | 5/2014 | Liu |
| 2014/0169599 | A1 | 6/2014 | Liu |
| 2014/0174459 | A1 | 6/2014 | Lamothe |
| 2014/0202477 | A1 | 7/2014 | Lamothe |
| 2014/0238423 | A1 | 8/2014 | Solum et al. |
| 2014/0238424 | A1 | 8/2014 | Macko et al. |
| 2014/0278250 | A1 | 9/2014 | Burstyn |
| 2014/0378057 | A1 | 12/2014 | Qi et al. |
| 2014/0378790 | A1 | 12/2014 | Tucker et al. |
| 2015/0040927 | A1 | 2/2015 | Li et al. |
| 2015/0099469 | A1 | 4/2015 | Smith et al. |
| 2015/0101625 | A1 | 4/2015 | Ramon et al. |
| 2015/0101940 | A1 | 4/2015 | Cohen |
| 2015/0133054 | A1 | 5/2015 | Goldstein |
| 2015/0134619 | A1 | 5/2015 | Newton et al. |
| 2015/0142387 | A1 | 5/2015 | Ash |
| 2015/0144145 | A1 | 5/2015 | Chen et al. |
| 2015/0172391 | A1 | 6/2015 | Factor et al. |
| 2015/0216237 | A1 | 8/2015 | Alarcon et al. |
| 2015/0224268 | A1 | 8/2015 | Chang et al. |
| 2015/0272220 | A1 | 10/2015 | Kasslin et al. |
| 2015/0312858 | A1 | 10/2015 | Wensley et al. |
| 2015/0313283 | A1 | 11/2015 | Henry et al. |
| 2015/0319555 | A1 | 11/2015 | Spinka et al. |
| 2015/0327596 | A1 | 11/2015 | Kerai |
| 2015/0358759 | A1 | 12/2015 | Collett et al. |
| 2016/0015081 | A1 | 1/2016 | Cordeiro et al. |
| 2016/0015082 | A1 | 1/2016 | Liu |
| 2016/0021488 | A1 | 1/2016 | Alarcon et al. |
| 2016/0029148 | A1 | 1/2016 | Jakusovszky et al. |
| 2016/0029149 | A1 | 1/2016 | Liu |
| 2016/0037012 | A1 | 2/2016 | Viswanadham et al. |
| 2016/0037566 | A1 | 2/2016 | Jackson et al. |
| 2016/0073692 | A1 | 3/2016 | Alarcon et al. |
| 2016/0089508 | A1 | 3/2016 | Okado |
| 2016/0100276 | A1 | 4/2016 | Jakusovszky et al. |
| 2016/0100311 | A1 | 4/2016 | Smith et al. |
| 2016/0105761 | A1 | 4/2016 | Viswanadham et al. |
| 2016/0121058 | A1 | 5/2016 | Chen |
| 2016/0184635 | A1 | 6/2016 | Kumar |
| 2016/0191642 | A1 | 6/2016 | Polo et al. |
| 2016/0262451 | A1 | 9/2016 | Kwon |
| 2016/0278163 | A1 | 9/2016 | Acar |
| 2016/0278435 | A1 | 9/2016 | Liu |
| 2016/0286863 | A1 | 10/2016 | Chen |
| 2016/0316819 | A1 | 11/2016 | Choukroun et al. |
| 2016/0338407 | A1 | 11/2016 | Lin |
| 2016/0345632 | A1 | 12/2016 | Lipowicz |
| 2016/0353798 | A1 | 12/2016 | Zhou et al. |
| 2016/0353800 | A1 | 12/2016 | Kerdemelidis |
| 2016/0363570 | A1 | 12/2016 | Liu |
| 2016/0363917 | A1 | 12/2016 | Di Carlo |
| 2016/0374133 | A1 | 12/2016 | Blackley |
| 2017/0020188 | A1 | 1/2017 | Blackley |
| 2017/0026905 | A1 | 1/2017 | Logue et al. |
| 2017/0041381 | A1 | 2/2017 | Cameron |
| 2017/0041868 | A1 | 2/2017 | Denboer et al. |
| 2017/0042242 | A1 | 2/2017 | Tal et al. |
| 2017/0093960 | A1 | 3/2017 | Palin et al. |
| 2017/0093981 | A1 | 3/2017 | Hon |
| 2017/0118292 | A1 | 4/2017 | Cameron |
| 2017/0127725 | A1 | 5/2017 | Xiang |
| 2017/0193816 | A1 | 7/2017 | Buchberger et al. |
| 2017/0223604 | A1 | 8/2017 | Lee et al. |
| 2017/0258136 | A1 | 9/2017 | Skillermark et al. |
| 2017/0265523 | A1* | 9/2017 | Lipowicz ..... H05B 3/26 |
| 2017/0273358 | A1 | 9/2017 | Hawes et al. |
| 2017/0273359 | A1 | 9/2017 | Liu |
| 2017/0303596 | A1 | 10/2017 | Chen |
| 2018/0018710 | A1* | 1/2018 | Tucker ..... A24F 47/00 |
| 2018/0062868 | A1 | 3/2018 | Batista et al. |
| 2018/0132102 | A1 | 5/2018 | Higo et al. |
| 2018/0184710 | A1* | 7/2018 | Tucker ..... A24F 40/42 |
| 2018/0270311 | A1 | 9/2018 | Kwon et al. |
| 2018/0270643 | A1 | 9/2018 | Baker et al. |
| 2018/0280640 | A1 | 10/2018 | Baker et al. |
| 2018/0286208 | A1 | 10/2018 | Baker et al. |
| 2018/0303163 | A1 | 10/2018 | Baker et al. |
| 2019/0286456 | A1 | 9/2019 | Achtien et al. |
| 2020/0029371 | A1 | 1/2020 | Kersey et al. |
| 2020/0060347 | A1 | 2/2020 | Blick et al. |
| 2020/0178607 | A1 | 6/2020 | Lee et al. |
| 2020/0237014 | A1 | 7/2020 | Zielazek et al. |
| 2020/0315254 | A1 | 10/2020 | Moloney et al. |
| 2020/0329356 | A1 | 10/2020 | Potter et al. |
| 2020/0352238 | A1 | 11/2020 | Simpson et al. |
| 2020/0359704 | A1 | 11/2020 | Deng |
| 2021/0093005 | A1 | 4/2021 | Potter et al. |
| 2021/0145055 | A1 | 5/2021 | Jung et al. |
| 2021/0251300 | A1 | 8/2021 | Alarcon et al. |
| 2021/0308392 | A1 | 10/2021 | Kersey et al. |
| 2022/0060873 | A1 | 2/2022 | Voges |
| 2022/0095688 | A1 | 3/2022 | Liu |
| 2023/0284694 | A1 | 9/2023 | Simpson et al. |

FOREIGN PATENT DOCUMENTS

| | | | |
|---|---|---|---|
| CN | 101800575 | A | 8/2010 |
| CN | 102035574 | A | 4/2011 |
| CN | 201781984 | U | 4/2011 |
| CN | 201830900 | U | 5/2011 |
| CN | 102684753 | A | 9/2012 |
| CN | 102970885 | A | 3/2013 |
| CN | 103380952 | A | 11/2013 |
| CN | 103798960 | A | 5/2014 |
| CN | 103914013 | A | 7/2014 |
| CN | 203913385 | U | 11/2014 |
| CN | 204120237 | U | 1/2015 |
| CN | 104366695 | A | 2/2015 |
| CN | 104412629 | A | 3/2015 |
| CN | 104488348 | A | 4/2015 |
| CN | 204351068 | U | 5/2015 |
| CN | 104664605 | A | 6/2015 |
| CN | 104720117 | A | 6/2015 |
| CN | 104811895 | A | 7/2015 |
| CN | 204426699 | U | 7/2015 |
| CN | 204483034 | U | 7/2015 |
| CN | 204483035 | U | 7/2015 |
| CN | 104955508 | A | 9/2015 |
| CN | 104980284 | A | 10/2015 |

(56) References Cited

FOREIGN PATENT DOCUMENTS

| | | | | | |
|---|---|---|---|---|---|
| CN | 105163614 | A | | 12/2015 | |
| CN | 105188428 | A | | 12/2015 | |
| CN | 105208882 | A | | 12/2015 | |
| CN | 105210420 | A | | 12/2015 | |
| CN | 105310114 | A | | 2/2016 | |
| CN | 105342010 | A | | 2/2016 | |
| CN | 105433442 | A | | 3/2016 | |
| CN | 205285008 | U | | 6/2016 | |
| CN | 205512338 | U | | 8/2016 | |
| CN | 205624465 | U | | 10/2016 | |
| CN | 106102811 | A | | 11/2016 | |
| CN | 106376976 | A | | 2/2017 | |
| CN | 106535682 | A | | 3/2017 | |
| CN | 106604655 | A | | 4/2017 | |
| CN | 206119177 | U | | 4/2017 | |
| CN | 206197019 | U | | 5/2017 | |
| CN | 206197020 | U | | 5/2017 | |
| CN | 107251583 | A | | 10/2017 | |
| CN | 107301020 | A | | 10/2017 | |
| CN | 107708452 | A | | 2/2018 | |
| CN | 108028859 | A | | 5/2018 | |
| EP | 1357712 | A1 | | 10/2003 | |
| EP | 1494403 | A3 | | 9/2009 | |
| EP | 2110034 | A1 | | 10/2009 | |
| EP | 2460424 | A1 | | 6/2012 | |
| EP | 2533477 | A1 | | 12/2012 | |
| EP | 2533477 | B1 | | 3/2014 | |
| EP | 2739020 | A2 | | 6/2014 | |
| EP | 2823720 | A1 | | 1/2015 | |
| EP | 2959784 | A1 | | 12/2015 | |
| EP | 2984952 | A1 | | 2/2016 | |
| EP | 3062643 | A1 | | 9/2016 | |
| EP | 3108759 | A1 | | 12/2016 | |
| GB | 2513639 | | * | 5/2014 | ..... A24F 47/00 |
| GB | 2513639 | A | | 11/2014 | |
| GB | 2521224 | A | | 6/2015 | |
| JP | 2001352377 | A | | 12/2001 | |
| JP | 2002044730 | A | | 2/2002 | |
| JP | 2002247097 | A | | 8/2002 | |
| JP | 2002252616 | A | | 9/2002 | |
| JP | 2003229782 | A | | 8/2003 | |
| JP | 2005159821 | A | | 6/2005 | |
| JP | 2005236819 | A | | 9/2005 | |
| JP | 2007036421 | A | | 2/2007 | |
| JP | 2009252002 | A | | 10/2009 | |
| JP | 2013524835 | A | | 6/2013 | |
| JP | 2014110635 | A | | 6/2014 | |
| JP | 2014110637 | A | | 6/2014 | |
| JP | 2015180214 | A | | 10/2015 | |
| JP | 2017514504 | A | | 6/2017 | |
| JP | 2017169185 | A | | 9/2017 | |
| JP | 2018032269 | A | | 3/2018 | |
| JP | 2018533924 | A | | 11/2018 | |
| JP | 2018536309 | A | | 12/2018 | |
| JP | 2020526222 | A | | 8/2020 | |
| JP | 2021506296 | A | | 2/2021 | |
| JP | 2021523685 | A | | 9/2021 | |
| KR | 20020057207 | A | | 7/2002 | |
| KR | 20120098343 | A | | 9/2012 | |
| KR | 20140002774 | U | | 5/2014 | |
| KR | 20150032188 | A | | 3/2015 | |
| KR | 101570106 | B1 | | 11/2015 | |
| KR | 20150140584 | A | | 12/2015 | |
| KR | 20160009678 | A | | 1/2016 | |
| KR | 101609715 | B1 | | 4/2016 | |
| RU | 2420901 | C2 | | 6/2011 | |
| RU | 2425608 | C2 | | 8/2011 | |
| RU | 2011120430 | A | | 11/2012 | |
| RU | 2509516 | C2 | | 3/2014 | |
| RU | 2536166 | C2 | | 12/2014 | |
| RU | 2598568 | C2 | | 9/2016 | |
| RU | 2606572 | C2 | | 1/2017 | |
| RU | 2620754 | C2 | | 5/2017 | |
| RU | 2636917 | C2 | | 11/2017 | |
| RU | 2638917 | C2 | | 12/2017 | |
| RU | 2639972 | C2 | | 12/2017 | |
| TW | 201513524 | A | | 4/2015 | |
| TW | 201613524 | A | | 4/2016 | |
| WO | 2005057956 | A1 | | 6/2005 | |
| WO | 2011137453 | A2 | | 11/2011 | |
| WO | WO-2011146375 | A2 | | 11/2011 | |
| WO | 2014060269 | A1 | | 4/2014 | |
| WO | 2014085719 | A1 | | 6/2014 | |
| WO | 2014088230 | A1 | | 6/2014 | |
| WO | 2014150704 | A2 | | 9/2014 | |
| WO | 2014195805 | A2 | | 12/2014 | |
| WO | 2015063126 | A1 | | 5/2015 | |
| WO | 2015099751 | A1 | | 7/2015 | |
| WO | 2016017909 | A1 | | 2/2016 | |
| WO | 2016037012 | A1 | | 3/2016 | |
| WO | 2016041209 | A1 | | 3/2016 | |
| WO | WO-2016079151 | A1 | | 5/2016 | |
| WO | 2016090531 | A1 | | 6/2016 | |
| WO | 2016108646 | A1 | | 7/2016 | |
| WO | 2016179271 | A1 | | 11/2016 | |
| WO | WO-2016176800 | A1 | | 11/2016 | |
| WO | WO-2016190222 | A1 | | 12/2016 | |
| WO | WO-2016198417 | A1 | | 12/2016 | |
| WO | WO-2016207357 | A1 | | 12/2016 | |
| WO | WO-2016208756 | A1 | | 12/2016 | |
| WO | WO-2017001818 | A1 | | 1/2017 | |
| WO | WO-2017001819 | A1 | | 1/2017 | |
| WO | 2017020188 | A1 | | 2/2017 | |
| WO | WO 2017015832 | A1 | * | 2/2017 | ..... A24F 40/10 |
| WO | 2017051173 | A1 | | 3/2017 | |
| WO | 2017051174 | A1 | | 3/2017 | |
| WO | 2017055795 | A1 | | 4/2017 | |
| WO | 2017055801 | A1 | | 4/2017 | |
| WO | 2017055802 | A1 | | 4/2017 | |
| WO | 2017203488 | A1 | | 11/2017 | |
| WO | WO-2017215221 | A1 | | 12/2017 | |
| WO | 2018202651 | A1 | | 11/2018 | |
| WO | 2019121778 | A1 | | 6/2019 | |

OTHER PUBLICATIONS

International Preliminary Report on Patentability for Application No. PCT/GB2018/050726, mailed on Jul. 3, 2019, 32 pages.
International Preliminary Report on Patentability for Application No. PCT/GB2019/050037, mailed on May 8, 2020, 21 pages.
International Preliminary Report on Patentability for Application No. PCT/GB2019/050186, mailed on May 8, 2020, 8 pages.
International Preliminary Report on Patentability for Application No. PCT/GB2019/050187 mailed on Aug. 6, 2020, 8 pages.
International Preliminary Report on Patentability for Application No. PCT/GB2019/050187 mailed on Jul. 28, 2020, 7 pages.
International Search Report and Written Opinion for Application No. PCT/GB2018/050726, mailed on Jun. 12, 2018, 15 pages.
International Search Report and Written Opinion for Application No. PCT/GB2019/050037, mailed on Mar. 25, 2019, 12 pages.
International Search Report for Application No. PCT/GB2019/050187, mailed on Apr. 18, 2019, 3 pages.
Notice of Reasons for Rejection for Japanese Application No. 2020-539826, mailed on Jun. 15, 2021, 14 pages.
Office Action for Canadian Application No. 3089292, mailed on Dec. 16, 2021, 6 pages.
Office Action for Chinese Application No. 201880020522.4, mailed on Aug. 3, 2021, 14 pages.
Office Action for Chinese Application No. 201880020522.4, mailed on May 20, 2022, 12 pages.
Office Action for Japanese Patent Application No. 2020-537201, mailed on Jul. 13, 2021, 5 pages.
Office Action for Korean Application No. 10-2019-7027899, mailed on Jan. 18, 2021, 17 pages.
Office Action for Korean Application No. 10-2019-7027899, mailed on Jul. 27, 2021, 15 pages.
Office Action for Russian Application No. 2020124567, mailed on Jan. 28, 2021, 2 pages.
Search Report for Russian Application No. 2020124379 mailed on Mar. 2, 2021, 2 pages.

(56) References Cited

OTHER PUBLICATIONS

Search Report mailed Apr. 27, 2017 for Great Britain Application No. GB1704674.9, 5 pages.
Search Report mailed May 31, 2017 for Great Britain Application No. GB1702861.4, 5 pages.
Second Office Action mailed Jan. 20, 2022 for Chinese Application No. 201880020522.4, 17 pages.
Baker, Application and File History for U.S. Appl. No. 15/762,018, filed Mar. 21, 2018, 446 Pages.
Baker, Application and File History for U.S. Appl. No. 15/762,021, filed Mar. 21, 2018, 442 Pages.
Baker, et al., Application and File History for U.S. Appl. No. 15/733,325, filed Jun. 26, 2020.
Bluetooth, Specification of the Bluetooth System: Experience More, Covered Core Package version: 4.0, Specification vol. 1, Jun. 30, 2010, 137 Pages.
Bronzi, et al., Bluetooth Low Energy for Inter-Vehicular Communications, 2014 IEEE Vehicular Networking Conference (VNC) IEEE, Dec. 3, 2014, pp. 215-221.
Communication pursuant to Article 94(3) EPC for European Patent Application No. 18715070.1, mailed on Aug. 4, 2022, 6 pages.
Decision of Grant received for Russian Patent Application No. 2019134027, mailed on Aug. 18, 2020, 10 pages (Official Copy Only).
Decision to Grant received for Japanese Patent Application No. 2020-531510, mailed on Sep. 21, 2021, 5 pages (2 pages of English Translation and 3 pages of Official Copy).
European Office Action, Application No. 16775827.5, dated Jan. 28, 2019, 5 Pages.
Examination Report No. 1 mailed Jun. 1, 2021 for New Zealand Application No. 765016, 4 Pages.
Examination Report No. 1 received for Australian Patent Application No. 2021254534,mailed on Oct. 5, 2022, 3 Pages.
Extended European Search Report for Application No. 20204701.5, mailed on Jan. 28, 2021, 8 Pages.
Extended European Search Report for Application No. 21201390.8, mailed on Jan. 28, 2022, 9 Pages.
Great Britain Search Report, Application No. GB 1516674.7, dated Feb. 18, 2016, 5 Pages.
IEEE 802.15 WPAN Task Group 1 (TGI), IEEE 802.15 as retrieved on Mar. 15, 2016., Mar. 15, 2016, 2 Pages.
IEEE Standard for Local Metropolitan Area Networks, Part 15.4: Low-Rate Wireless Personal Area Networks (LR-WPANs), IEEE Std 802.15.4, Sep. 5, 2011, 314 Pages.
IEEE Standard, IEEE 802.11 as retrieved on Feb. 19, 2018, 2016, 2 Pages.
International Preliminary Report on Patentability for Application No. PCT/EP2018/061086, mailed on Oct. 10, 2019, 15 Pages.
International Preliminary Report on Patentability for Application No. PCT/EP2018/086624, mailed Mar. 16, 2020, 15 Pages.
International Preliminary Report on Patentability for Application No. PCT/GB2016/052939, mailed on Sep. 14, 2017, 9 Pages.
International Preliminary Report on Patentability, for Application No. PCT/EP2018/086791, mailed Mar. 12, 2020, 13 Pages.
International Preliminary Report on Patentability, International Application No. PCT/GB2016/052940, mailed Sep. 14, 2017, 8 Pages.
International Search Report and Written Opinion for Application No. PCT/EP2018/086624, mailed Feb. 11, 2019, 13 Pages.
International Search Report and Written Opinion received for PCT Patent Application No. PCT/GB2016/052939, mailed on Nov. 18, 2016, 17 Pages.
International Search Report and Written Opinion received for PCT Patent Application No. PCT/GB2019/050089, mailed on Mar. 25, 2019, 10 pages.
International Search Report and Written Opinion received for PCT patent Application No. PCT/EP2018/061086, mailed on Jul. 11, 2018, 14 Pages.
International Search Report and Written Opinion, for Application No. PCT/EP2018/086791, mailed Feb. 13, 2019, 14 Pages.
International Search Report and Written Opinion, International Application No. PCT/GB2016/052940, mailed Dec. 8, 2016, 12 Pages.
Japanese Office Action, Application No. 2018-513274, dated Jan. 31, 2019, 4 pages (2 pages of English Translation and 2 pages of Official Copy).
Japanese Office Action, Application No. 2018-513357, dated Jan. 29, 2019, 7 Pages (3 Pages of English Translation and 4 Pages of Official Copy).
Moloney, Patrick, et al., Application and File History for U.S. Appl. No. 15/733,324, filed Jun. 26, 2020.
Moloney, Patrick, et al., Application and File History for U.S. Appl. No. 16/610,587, filed Nov. 4, 2019.
Notice of Allowance received for Korean Patent Application No. 10-2020-7021264, mailed on Nov. 14, 2022, 6 pages (3 pages of English Translation and 3 pages of Official Copy).
Notice of Allowance received for Korean Patent Application No. 10-2022-7001663, mailed on Feb. 16, 2023, 6 pages (3 pages of English Translation and 3 pages of Official Copy).
Notice of Allowance received for Korean Patent Application No. 10-2022-7001975, mailed on Feb. 16, 2023, 4 pages (1 page of English Translation and 3 pages of Official Copy).
Notice of Reasons for Refusal mailed Nov. 24, 2021 for Japanese Application No. 2020-183041, 8 pages (4 pages of English Translation and 4 pages of Official Copy).
Notice of Reasons for Rejection received for Japanese Patent Application No. 2021-148436, mailed on Nov. 29, 2022, 8 pages (4 pages of English Translation and 4 pages of Official Copy).
Office Action and Search Report received for Chinese Application No. 2018800844162, mailed Dec. 22, 2022, 17 pages (8 pages of English Translation and 9 pages of Official Copy).
Office Action for Chinese Application No. 201880029165.8, mailed on Mar. 16, 2022, 16 pages (8 pages of English Translation and 8 pages of Official Copy).
Office Action for Japanese Application No. 2020-530641, mailed on Aug. 17, 2021, 5 pages (2 pages of English Translation and 3 pages of Official Copy).
Office action for Japanese Application No. 2021-169568, mailed on Aug. 23, 2022, 16 pages (8 pages of English Translation and 8 pages of Official Copy).
Office action for Korean Application No. 10-2022-7001663, mailed on Aug. 10, 2022, 12 pages (7 pages of English Translation and 5 pages of Official Copy).
Office Action for Russian Application No. 2020120938, mailed on Nov. 11, 2020, 13 pages (Official Copy Only).
Office Action for Russian Application No. 2020121494, mailed on Nov. 18, 2020, 6 pages (Official Copy Only).
Office Action for Russian Application No. 2020135708, mailed on May 24, 2021, 16 pages (6 pages of English Translation and 10 pages of Official Copy).
Office Action mailed May 11, 2022 for Russian Application No. 2021132532, 12 pages (5 pages of English Translation and 7 pages of Official Copy).
Office Action mailed Nov. 15, 2021 for Japanese Application No. 2020-183041, 42 pages (25 pages of English Translation and 17 pages of Official Copy).
Office Action mailed Apr. 21, 2021 for Korean Application No. 10-2020-7018465, 11 pages (6 pages of English Translation and 5 pages of Official copy).
Office Action received for Chinese Patent Application No. 201680047153.9, mailed on Nov. 21, 2019, 19 pages (11 pages of English Translation and 8 pages of Official Copy).
Office Action received for Chinese Patent Application No. 201980009907.5, mailed on Nov. 2, 2022, 17 pages (9 pages of English Translation and 8 pages of Official Copy).
Office Action received for Korean Patent Application No. 10-2019-7032414, mailed on Jul. 30, 2020, 11 pages (5 pages of English Translation and 6 pages of Official copy).
Office Action received for Russian Patent Application No. 2022114546, mailed on Nov. 18, 2022, 6 pages (Official Copy Only).
Otiaba, et al., Application and File History for U.S. Appl. No. 16/610,588, filed Nov. 4, 2019, 242 Pages.

(56) References Cited

OTHER PUBLICATIONS

Partial Search Report received for Great Britain Patent Application No. GB1516673.9, mailed on Feb. 18, 2016, 4 Pages.
Russian Decision to Grant, Application No. 2018109578, dated Apr. 3, 2019, 12 Pages (Official Copy Only).
Russian Decision to Grant, Application No. 2018109786, dated Dec. 13, 2018, 10 pages (Official Copy Only).
Russian Search Report, Application No. 2018109786, dated Dec. 13, 2018, 2 pages (Official Copy Only).
Second Written Opinion received for PCT patent Application No. PCT/EP2018/061086, mailed on Jul. 23, 2019, 8 Pages.
Vaporesso, What's the Difference Between an Atomizer, Cartomizer and Clearomizer?, Available at <https://www.vaporesso.com/blog/difference-between-an-atomizer-cartomizer-and-clearomizer>, Aug. 7, 2019, 6 pages.
Written Opinion of International Preliminary Authority for Application No. PCT/EP2018/086624, mailed Nov. 25, 2019, 6 Pages.
Written Opinion received for PCT patent Application No. PCT/EP2018/061086, mailed on Apr. 10, 2019, 8 Pages.
Yong, et al., A Bluetooth Scatternet-Route Structure for Multihop Ad Hoc Networks, IEEE Journal on Selected Areas in Communications, vol. 21, No. 2, Feb. 1, 2003, pp. 229-239.

* cited by examiner

AEROSOL SOURCE FOR A VAPOR PROVISION SYSTEM

PRIORITY CLAIM

The present application is a National Phase entry of PCT Application No. PCT/GB2019/050187, filed Jan. 23, 2019, which claims priority from Patent Application No. 1801146.0, filed Jan. 24, 2018, which is hereby fully incorporated herein by reference.

TECHNICAL FIELD

The present disclosure relates to an aerosol source for an electronic vapor provision system such as an e-cigarette.

BACKGROUND

Many electronic vapor provision systems, such as e-cigarettes and other electronic nicotine delivery systems that deliver nicotine via vaporized liquids, and hybrid devices which additionally include a portion of tobacco or other flavor element through which vapor generated from a liquid is passed, are formed from two main components or sections, namely a cartomizer and a control unit (battery section). The cartomizer generally includes a reservoir of liquid and an atomizer for vaporizing the liquid. These parts may collectively be designated as an aerosol source. The atomizer may be implemented as an electrical (resistive) heater, such as a wire formed into a coil or other shape, and a wicking element in proximity to the heater which transports liquid from the reservoir to the heater. The control unit generally includes a battery for supplying power to the atomizer. Electrical power from the battery is delivered to the heater, which heats up to vaporize a small amount of liquid delivered by the wicking element from the reservoir. The vaporized liquid is then inhaled by the user.

The reservoir has an at least one opening by which liquid can leave the reservoir to flow along the wicking element. Leakage may occur at this opening. Also, sometimes the wicking element may absorb more liquid than the heater is able to vaporize, for example in the event of environmental pressure changes or physical shocks. This gives an excess of free liquid in the wicking element, which can result in leakage. Liquid may drip from the base of the atomizer, for example. Accordingly, approaches for reducing liquid leaks are of interest.

SUMMARY

According to a first aspect of some embodiments described herein, there is provided an aerosol source for a vapor provision system comprising: a vapor generating element; a reservoir for holding source liquid, the reservoir being bounded by a wall having an opening therein; and a liquid transport element for delivering liquid from the reservoir to the vapor generating element, the liquid transport element having at least one end part inserted into the opening, the end part having a flared portion arranged in contact with the wall of the reservoir to provide a seal for the opening.

According to a second aspect of some embodiments described herein, there is provided a vaporizer for a vapor provision system comprising: a vapor generating element for generating vapor from a liquid; and a liquid transport element for delivering liquid from a reservoir to the vapor generating element, the liquid transport element having at least one end part configured for insertion into an opening in a wall of the reservoir, the end part having a flared portion configured to be arranged in contact with the wall of the reservoir to provide a seal for the opening.

According to a third aspect of some embodiments described herein, there is provided a liquid transport element for a vapor provision system, the liquid transport element configured for delivering liquid from a reservoir to a vapor generating element, and comprising: at least one end part configured for insertion into an opening in a wall of a reservoir, the end part having a flared portion configured to be arranged in contact with the wall of the reservoir to provide a seal for the opening.

According to a fourth aspect of some embodiments described herein, there is provided a cartomizer for a vapor provision system, comprising an aerosol source according to the first aspect, a vaporizer according to the second aspect or a liquid transport element according to the third aspect.

According to a fifth aspect of some embodiments described herein, there is provided a vapor provision system comprising an aerosol source according to the first aspect, a vaporizer according to the second aspect, a liquid transport element according to the third aspect, or a cartomizer according to the fourth aspect.

According to a sixth aspect of some embodiments described herein, there is provided an aerosol source for a vapor provision system comprising: a vapor generating element; a reservoir for holding source liquid, the reservoir being bounded by a wall having an opening therein; a liquid transport element for delivering liquid from the reservoir to the vapor generating element, the liquid transport element having at least one end part inserted into the opening; and a plugging element penetrating the end part of the liquid transport element along an axis substantially parallel to a bore of the opening so as to press the end part against a surface of the wall of the reservoir that forms the bore, to provide a seal for the opening.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an aerosol source or a vapor provision system including an aerosol source may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The disclosure is also applicable to hybrid devices and systems configured to deliver nicotine or other substances by vaporizing liquid and passing the vapor through a solid substrate such as tobacco. The various terms noted above should be understood to include such devices. Similarly, "aerosol" may be used interchangeably with "vapor".

As used herein, the term "component" is used to refer to a part, section, unit, module, assembly or similar of an electronic cigarette that incorporates several smaller parts or elements, often within an exterior housing or wall. An electronic cigarette may be formed or built from one or more such components, and the components may be removably connectable to one another, or may be permanently joined together during manufacture to define the whole electronic cigarette.

Figure 1:
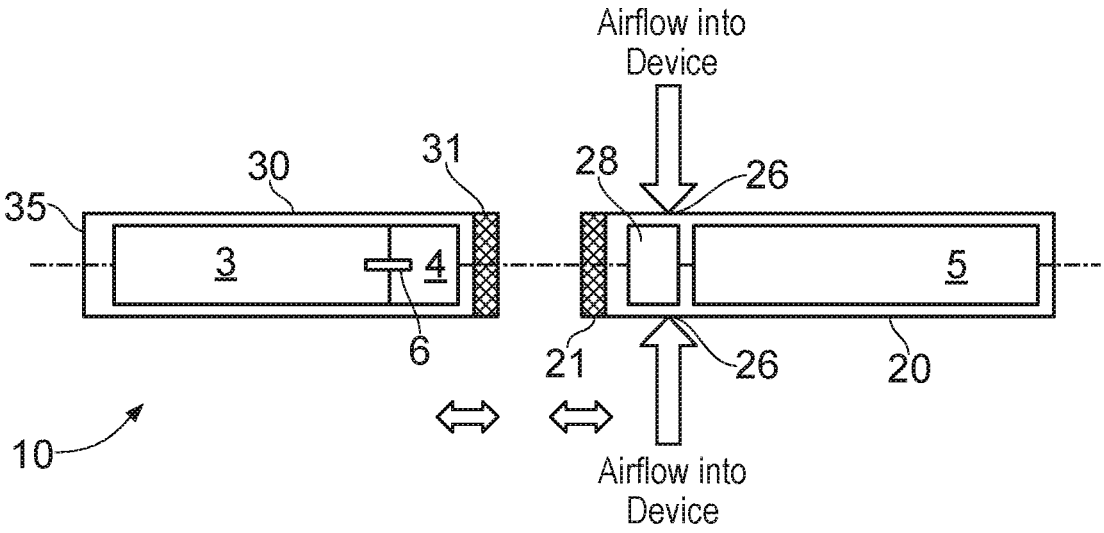
FIG. 1 shows a cross-section through an example e-cigarette comprising a cartomizer and a control unit in which examples may be implemented.

FIG. 1 is a highly schematic diagram (not to scale) of an example aerosol/vapor provision system such as an e-cigarette 10. The e-cigarette 10 has a generally cylindrical shape, extending along a longitudinal axis indicated by a dashed line, and comprises two main components, namely a control or power component or section 20 and a cartridge assembly or section 30 (sometimes referred to as a cartomizer or clearomizer) that operates as a vapor-generating component.

The cartridge assembly 30 includes a reservoir 3 containing a source liquid comprising a liquid formulation from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated) such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. Alternatively, the reservoir 3 may contain a quantity of absorbent material such as cotton wadding, glass fiber or porous ceramic which holds the source liquid within a porous structure. The reservoir 3 may be sealed after filling during manufacture so as to be disposable after the source liquid is consumed, or may have an inlet port or other opening through which new source liquid can be added. The cartridge assembly 30 also comprises an electrical heating element or heater 4 located externally of the reservoir tank 3 for generating the aerosol by vaporization of the source liquid by heating. A liquid transfer arrangement (liquid transport element) such as a wick or other porous element 6 may be provided to deliver source liquid from the reservoir 3 to the heater 4. The wick 6 has one or more parts located inside the reservoir 3, or otherwise in fluid communication with the liquid in the reservoir 3, so as to be able to absorb source liquid and transfer it by wicking or capillary action to other parts of the wick 6 that are in contact with the heater 4. This liquid is thereby heated and vaporized, to be replaced by new source liquid transferred to the heater 4 by the wick 6. The wick may be thought of as a bridge, path or conduit between the reservoir 3 and the heater 4 that delivers or transfers liquid from the reservoir to the heater. Terms including conduit, liquid conduit, liquid transfer path, liquid delivery path, liquid transfer mechanism or element, and liquid delivery mechanism or element may all be used interchangeably herein to refer to a wick or corresponding component or structure.

A heater and wick (or similar) combination is sometimes referred to as an atomizer or vaporizer, or atomizer assembly or vaporizer assembly, and the reservoir with its source liquid plus the atomizer may be collectively referred to as an aerosol source. Other terminology may include a liquid delivery assembly, a liquid transfer assembly, or simply assembly, where in the present context these terms may be used interchangeably to refer to a vapor-generating element (vapor generator) and a wicking or similar component or structure (liquid transport element) that delivers or transfers liquid from a reservoir to the vapor generator. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example). Other means for vapor generation may be used in place of a heater, such a vibrating vaporizer based on the piezoelectric effect, for example. In an electrical or electronic device, the vapor generator may be an electrical heating element that operates by ohmic (Joule) heating or by inductive heating. Also, the device may be a non-electrical device, that operates by pump-action, for example. In general, therefore, an atomizer can be considered to be a vapor-generating or vaporizing element able to generate vapor from source liquid delivered to it, and a liquid transport element able to deliver or transport liquid from a reservoir or similar liquid store to the vapor generator by a wicking action/capillary force. Embodiments of the disclosure are applicable to all and any such assembly configurations. Regardless of the implementation, the parts will be configured to form a liquid flow path by which the source liquid is able to travel from the interior of the reservoir 3 to the vicinity and surface of the heater 4 (or other vapor generator) for vaporizating. This is the intended fluid path, whereby liquid is delivered to the heater and should be successfully vaporized and thereby prevented from forming a leak by which liquid may escape into other locations inside or outside the electronic cigarette. This operation is based on a delivery of source liquid at an expected rate such that the vapor generator can handle the incoming liquid. However, in the event of leakage such as may be caused by excess pressure inside the reservoir, or even under normal pressure conditions when the vapor generator is not operating, too much liquid may accumulate in or at the wicking element, or liquid may escape from reservoir via the opening through which the wicking element receives the liquid. Any such liquid may then drip away to escape as free liquid in a chamber housing the atomizer.

Returning to FIG. 1, the cartridge assembly 30 also includes a mouthpiece 35 having an opening or air outlet through which a user may inhale the aerosol generated by the heater 4.

The power component 20 includes a cell or battery 5 (referred to herein after as a battery, and which may be re-chargeable) to provide power for electrical components of the e-cigarette 10, in particular the heater 4. Additionally, there is a printed circuit board 28 and/or other electronics or circuitry for generally controlling the e-cigarette. The control electronics/circuitry connect the heater 4 to the battery 5 when vapor is required, for example in response to a signal from an air pressure sensor or air flow sensor (not shown) that detects an inhalation on the system 10 during which air enters through one or more air inlets 26 in the wall of the power component 20. When the heating element 4 receives power from the battery 5, the heating element 4 vaporizes source liquid delivered from the reservoir 3 by the wick 6 to generate the aerosol, and this is then inhaled by a user through the opening in the mouthpiece 35. The aerosol is carried from the aerosol source to the mouthpiece 35 along an air channel (not shown) that connects the air inlet 26 to the aerosol source to the air outlet when a user inhales on the mouthpiece 35. An air flow path through the electronic cigarette is hence defined, between the air inlet(s) (which may or may not be in the power component) to the atomizer and on to the air outlet at the mouthpiece. In use, the air flow direction along this air flow path is from the air inlet to the air outlet, so that the atomizer can be described as lying downstream of the air inlet and upstream of the air outlet.

In this particular example, the power section 20 and the cartridge assembly 30 are separate parts detachable from one another by separation in a direction parallel to the longitudinal axis, as indicated by the solid arrows in FIG. 1. The components 20, 30 are joined together when the device 10 is in use by cooperating engagement elements 21, 31 (for example, a screw or bayonet fitting) which provide mechanical and electrical connectivity between the power section 20 and the cartridge assembly 30. This is merely an example arrangement, however, and the various components may be differently distributed between the power section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. Alternatively, the e-cigarette 10 may be a unitary device (disposable or refillable/rechargeable) that cannot be separated into two parts, in which case all components are comprised within a single body or housing. Embodiments and examples of the present disclosure are applicable to any of these configurations and other configurations of which the skilled person will be aware.

Figure 2:
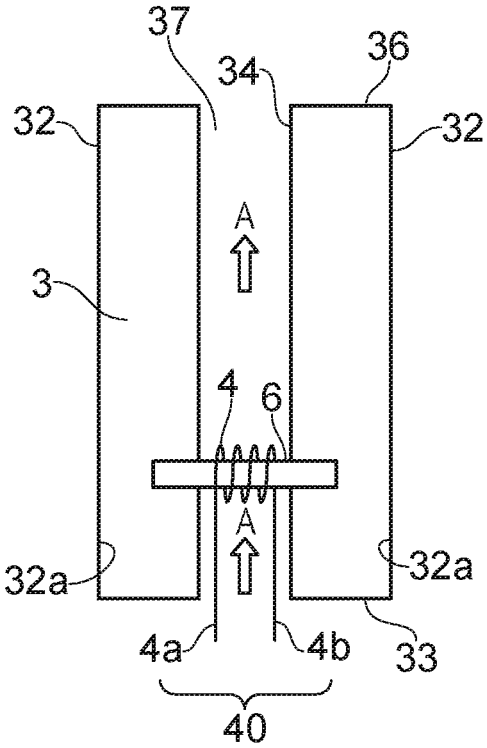
FIG. 2 shows a cross-sectional side view of a vapor-generating assembly including a reservoir, wick and heater.

The example device in FIG. 1 is presented in a highly schematic format. FIG. 2 shows a more detailed representation of an aerosol source indicating example positions of a tank, a heater and a wick.

FIG. 2 shows a cross-sectional side view of an example aerosol source. A reservoir tank 3 has an outer wall 32 and an inner wall 34, each of which is generally tubular. The inner wall 34 is centrally disposed within the outer wall 32 to define an annular space between the two walls; this is the interior volume of the tank 3 intended to hold source liquid. The tank is closed at its lower end (in the orientation depicted) by a bottom wall 33 and at its top end by an upper wall 36. The central space encompassed by the inner wall 34 is a passage or channel 37 which at its lower end receives air drawn into the electronic cigarette (such as via air intakes 26 shown in FIG. 1), and at its upper end delivers aerosol for inhalation (such as through the mouthpiece 35 in FIG. 1). It also defines a chamber housing the atomizer.

Disposed within the airflow channel 37 is the atomizer 40 comprising a heater 4 and a wick 6. The wick, an elongate porous element that in this example is rod-shaped and may be formed from multiple fibers, is arranged across the airflow passage (shown as closer to the lower end of the tank 3, but it may be positioned higher) so that its ends pass through apertures or openings in the inner wall 34 and reach into the interior volume of the tank 3 to absorb source liquid therein. The heater 4 is an electrically powered heating element in the form of a wire coil wrapped around the wick 6. Connecting leads **4*a*, 4*b* join the heater 4 to a circuit (not shown) for the provision of electrical power from a battery. The aerosol source will be disposed within the housing of a cartridge assembly section of an electronic cigarette, with a mouthpiece arranged at its top end and a controller and battery arranged at its lower end or at its side (possibly in a separable component). Note that the outer wall 32 of the tank 3 may or may not also be a wall of the cartridge assembly housing. If these walls are shared, the cartridge assembly may be intended to be disposable when the source liquid has been consumed, to be replaced by a new cartridge assembly connectable to an existing battery/power section, or may be configured so that the reservoir tank 3 can be refilled with source liquid. If the tank wall and the housing wall are different, the tank 3** or the whole aerosol source may be replaceable within the housing when the source liquid is consumed, or may be removable from the housing for the purpose of refilling. These are merely example arrangements and are not intended to be limiting.

In use, when the aerosol source within its assembly housing is joined to a battery section (separably or permanently depending on the e-cigarette design), and a user inhales through the mouthpiece, air drawn into the device through an inlet or inlets enters the airflow channel 37. The heater 4 is activated to produce heat; this causes source liquid brought to the heater 4 by the wick 6 to be heated to vaporization. The vapor is carried by the flowing air further along the airflow channel 37 to the mouthpiece of the device to be inhaled by the user. The arrows A indicate the airflow and its direction along the air flow path through the device.

It will be appreciated that such an arrangement is potentially vulnerable to leaks. Leakage of the liquid directly from the reservoir 3 through the apertures by which the wick 6 enters the tank interior may occur. Also, if the wick absorbs more liquid than can be removed by the vaporization action, this liquid may drip from the wick 6. In such ways, free liquid may arrive into the airflow channel 37, where it might be inhaled by the user together with the vapor, thereby spoiling the vaping experience, or might travel downwards to leak altogether out of the electronic cigarette, soiling the user or his possessions, or to contaminate other parts of the electronic cigarette such as the battery or the control electronics.

To address this, the present disclosure proposes that an end part of the wick (wicking element or liquid transport element) associated with an opening in the reservoir by being inserted into the opening or extending through it, is provided with a flared portion that is placed in contact with a surface of the wall at or near the opening. The contact provides a degree of sealing for the opening to reduce leakage, and may be located inside the reservoir, against the inner surface of the reservoir wall, or inside the opening, against the part of the reservoir wall that forms the side or sides of the opening and hence defines the bore of the opening. The flared portion may extend around the perimeter of the end of the wick, for example giving a trumpet or bell shape with a hollow center. The flared portion can thereby be placed in contact with the reservoir wall around the full perimeter of the opening, to maximize the sealing effect.

Figure 3:
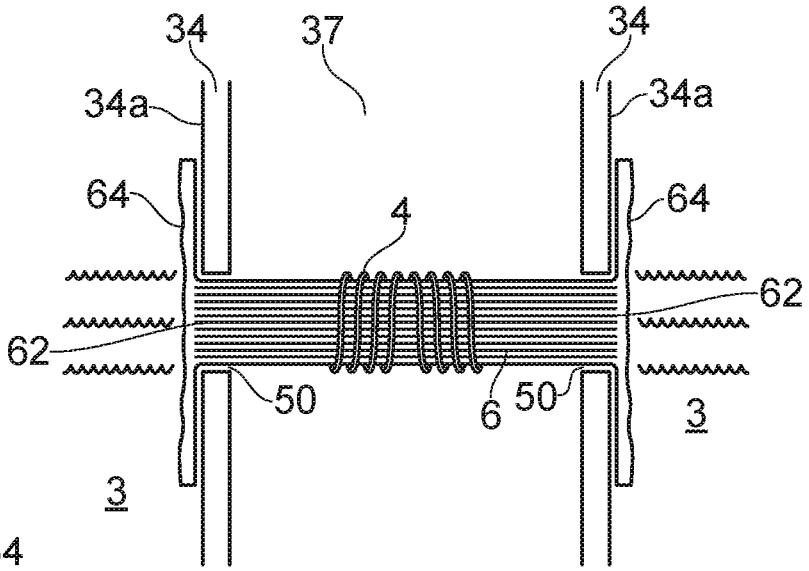
FIG. 3 shows a cross-sectional side view of a vapor-generating assembly or aerosol source configured according to an example of the disclosure.

FIG. 3 shows a cross-sectional side view of a first example aerosol source configured in accordance with the present disclosure. Similarly to the FIG. 2 aerosol source, an annular reservoir 3 is provided, with two openings 50 in the inner annular wall 34 arranged on opposite sides of the air flow channel 37. A wick or liquid transport element 6 is positioned across the channel 37 and has an associated vapor generating element 4 in the form of a heating coil wrapped around the liquid transport element 6. Leads providing the electrical supply for the heating coil are not depicted for simplicity. The liquid transport element 6, formed of porous material, has an elongate rod-like shape with the heating coil around its central part, between two end parts 62. Each end part 62 is inserted into a corresponding opening 50 in the reservoir wall so as to be exposed to liquid held in the reservoir 3. Liquid is absorbed by the end parts 62 and carried by wicking or capillary action through pores in the porous material of the wick to the heating coil 4 for vaporization.

Each end part 62 is provided with a flared portion 64, such that the wick ends terminate in a flared shape, where the flared portion extends outwardly from the sides of the wick, reaching outwardly from the longitudinal axis of the elongate wick around a hollow space. In this example, the flared portion is arranged at right angles to the wick axis, so the hollow space is no longer bounded by wick material. The flared portion 64 is located inside the reservoir 3, and the right angle arises because the flared portion 64 is in contact with the inner surface 34*a* of the reservoir wall 34, over a region peripheral to the opening 50. The wick end is perpendicular to the wall 34 as it passes through the opening 50, and the wall 34 is flat, so a right angle is required to form the contact between the flared portion 64 and the wall 34. Other configurations of wall, other angles of entry of the wick 6 into the reservoir 3, and other relative positions of the wall 34 and the wick 6, will require other angles (which may be greater or less than a right angle) to achieve the contact. It is likely that the angle will be relatively large however, and in this example and similar examples, the flared portion 64 can be considered as forming a flange around the end 62 of the wick 6.

Contact between the flared portion 64 and the inner surface 34*a* of the reservoir wall 34 provides a sealing effect to inhibit leakage of liquid through the opening 50. Material of the flared portion 64 extends across any gaps between the wick and the side wall of the opening 50, thereby at least partially blocking any fluid flow path that might otherwise exist. Some capillary sealing effect may arise from the contact between the flared portion and the inner surface 34*a*, owing to the wet environment inside the reservoir 3.

The flared portion 64 may be held in place against the inner wall surface 34*a* by the pressure of liquid in the reservoir 3, if the reservoir is a store of free liquid, or by the presence of any absorbent material placed inside the reservoir to hold the liquid. Alternatively, the flared portion 64 might be bonded to the inner surface 34*a*, such as by adhesive, by welding if the wall material and the wick material are suitable, or by mechanical means such as a clamp.

The wick 6 may be formed from fibers laid roughly parallel so as to extend along the length of the wick, and held in a bundle (such as being secured by the windings of the heating coil 4, or by other fastenings) or twisted or spun into a thread, yarn or rope structure, comprising one or more plies. In such a case, the flared portion 64 may be formed on the wick 6 by unravelling or untwisting the fibers (if necessary) over a short distance at an end of the length of material, and splaying the fibers out so they are separated from their neighbors and extend sideways from the length of the wick. The fibers can be bent or folded back until the appropriate angle required for contact with the inner wall surface 34*a* of the reservoir is attained. This process of forming the flared portion might be performed after the wick end is inserted into the opening in the reservoir wall, for example. Other walls of the reservoir may be added afterwards to complete the enclosing of the reservoir volume, to allow better access to the interior of the reservoir for this purpose.

Figure 3A:
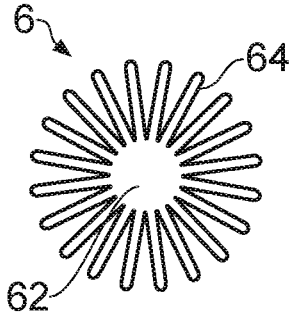
FIG. 3A shows an end view of a liquid transport element comprised in the FIG. 3 example.

FIG. 3A shows an end view of a wick 6 with a flared end 64 formed in this way. The separated fibers (which may be individual, or collected in small groups) splay out around the end 62 of the wick, forming the shape of a flower or a sun with rays. The end 62 can absorb liquid from the reservoir 3, and other liquid may be absorbed by the fibers of flared portion 64 and carried to the end 62 by wicking. In this example, the flared portion 64 extends fully around the wick 6, providing a sealing effect around the whole perimeter of the opening 50. In other examples, the flared portion 64 may be less extensive and extend over a part or parts of the opening's peripheral area only.

Figure 4:
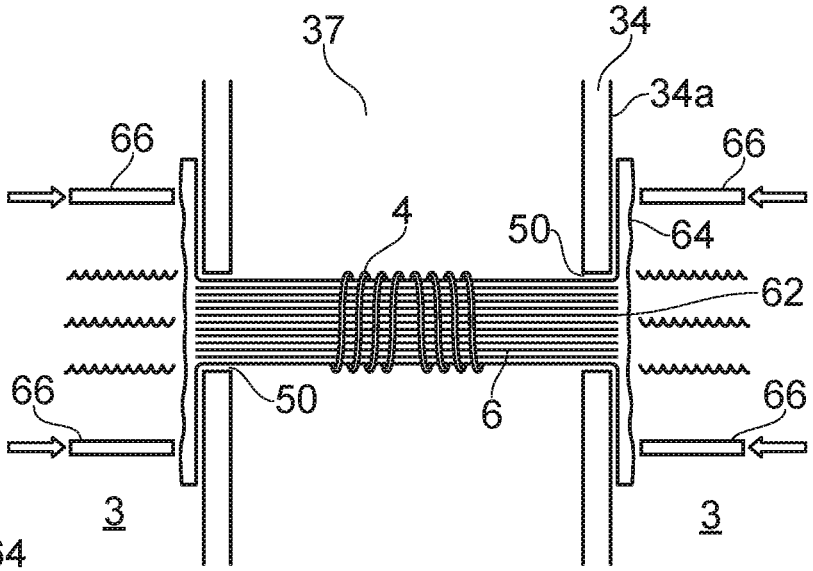
FIG. 4 shows a cross-sectional side view of an aerosol source configured according to a further example of the disclosure.

FIG. 4 shows a cross-sectional side view of a further example aerosol source configured in accordance with the present disclosure. This example is a modified version of that shown in FIG. 3, so the description of like parts will not be repeated. This example differs from that of FIG. 3 in that it additionally includes a compression member 66 provided inside the reservoir 3 and positioned to press the flared portion 64 against the inner wall surface 34*a*, thereby improving the contact between the two components and enhancing the sealing effect. The compression member 66 (shown slightly spaced apart from the flared portion 64 for clarity) exerts a compressive force against the flared portion 64 in the direction of the arrows, being the longitudinal axial direction of the wick 6. A compression member 66 may be used alone to keep the flared portion 64 in contact with the inner wall surface, or might be used together with any of the various contact arrangements noted above for FIG. 3.

FIG. 4 shows the compression member 66 spaced outwardly from the edge of the opening 50 so as not to impede access of liquid to the end part 62 of wick 6. A closer position, including at the opening's edge, might be used if advantageous.

Figure 4A:
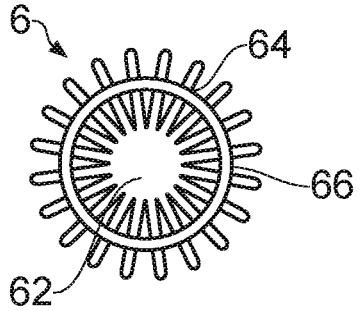
FIG. 4A shows an end view of a liquid transport element comprised in the FIG. 4 example.

FIG. 4A shows an end view of the flared portion 64 of the wick 6, comprising splayed fibers as in FIG. 3A, held by the compression member 66 pressed against the flared end 64. In this example, the compression member has the form of a ring or short tube, with a diameter greater than that of the opening so as to press the flared end 64 against the inner surface 34*a* in a peripheral position at a distance from the edge of the opening 50. The ring shape provides a continuous line of contact between the flared portion 64 and the inner surface 34*a*, providing a seal all around the opening 50. If the compression member 66 comprises a tube of significant length, as in FIG. 4, it may have apertures provided in the tube wall to allow freer movement of liquid within the reservoir and towards the opening 50. Alternatively, the tube might be formed from a mesh material with many pores through which liquid can flow. Otherwise, the compression member might comprise a number of discrete members that aid the contact at a number of locations over the area of the flared portion. The compression member or members may be held in place by being mounted on or secured to any wall of the reservoir, for example.

The flared portion of the liquid transport element may be arranged in contact with the reservoir wall in a variety of ways to provide a sealing effect; the arrangement is not limited to the configuration of FIGS. 3 and 4. For example, the flared portion may contact the reservoir wall inside the opening. The opening in the reservoir wall is in effect a hole through the reservoir wall. The hole may be defined as a bore, where the bore itself has a side wall or walls that are also a surface of the reservoir wall.

Figure 5:
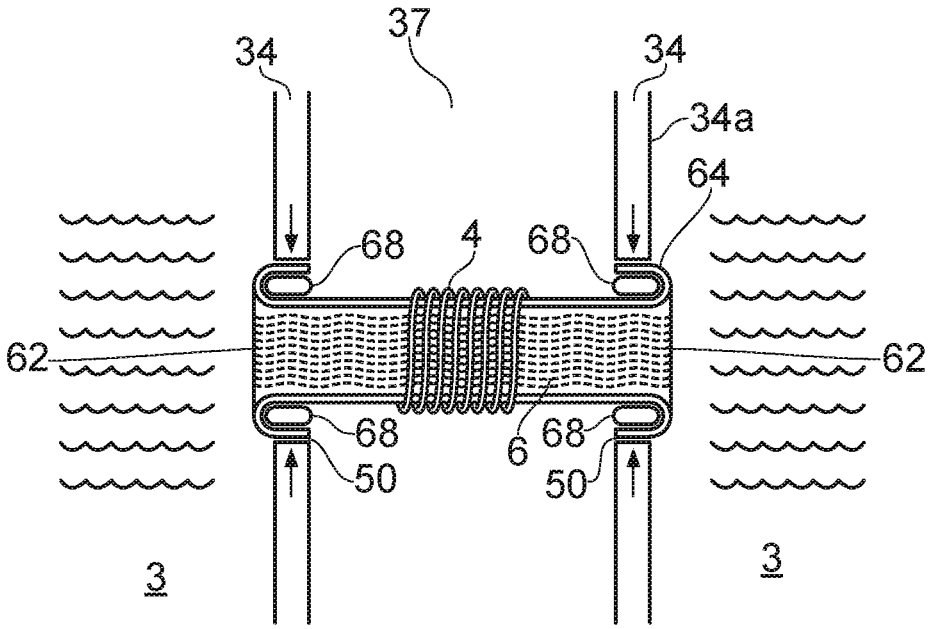
FIGS. 5 to 10 show cross-sectional side views of further aerosol sources configured according to additional examples of the disclosure.

FIG. 5 shows a cross-sectional side view of an example aerosol source configured with the flared portion of the wick in contact with the wall of the bore or opening. Aside from differences in the association between the wick 6 and the wall 34 of the reservoir 3, the aerosol source is configured as in the previous examples so the description will not be repeated here.

In this example, the flared portion 64 at the end part 62 of the wick 6 is located inside the bore of the opening 50, rather than inside the main part of the reservoir 3 as in the previous examples. A ring-shaped member (ring) 68 is also included; this has a central hole and an outer shape which need not be circular, but can match, or is similar to, the shape and size of the opening 50 in the plane of the wall 34 so that the ring 68 can be closely fitted inside the bore of the opening 50. The wick 6 passes through the central hole of the ring 68 and is positioned so that the end part 62 is encompassed by the ring 68. The flared portion 64 of the wick 6 curves outwardly and back, towards the central part of the wick 6 where the heating coil 4 is accommodated, and over the ring 68 in its position around the wick end 62. The ring 68 is thus on an outer surface of the flared portion 64. Thus, when the wick 6 and the ring 68 are together inserted into the opening 50, the area of the opening is substantially filled, and the flared portion 64 is located between the outer edge of the ring 68 and the surface of the wall that forms the bore of the opening 50. The end surface of the wick 6, being the surface of the end part 62 which is surrounded by the flared portion 64 as it extends outwardly, is substantially flush with the inner surface 34*a* of the reservoir wall 34 (although it may be somewhat ahead or behind of this position depending on the thickness of the ring 68 and the position of the ring 68 relative to the depth of the bore of the opening 50). The flared portion 64 is thus in contact with the wall of the reservoir 3 as it defines the surface of the bore, around the filling of the opening by the wick end part 62, the ring 68 and the flared portion 64 as it wraps over the ring 68, and a sealing effect is provided to inhibit fluid from being able to leave the reservoir 3 other than by absorption in the end part 62 of the wick 6. The flared portion 64 is compressed between the surface of the wall defining the bore and the ring 68, with the reservoir wall providing a compressive force along a radial direction of the wick, as shown by the arrows in the Figure. The ring 68 may be made from a rigid inflexible material, such as a rigid plastic or ceramic material, or a non-corrosive metal, for a maximum compressive effect, and shaped and sized so that its outer width and circumference matches that of the opening 50, and its inner width and circumference matches that of the wick 6. The wall 34 may be clamped onto, against or around the ring 68 to enhance the seal. There is no requirement for the ring 68 to compress the wick 6 at the end part 62, such as could occur if the central hole of the ring is smaller than the cross-sectional size of the wick, because the end part 62 fills the opening 50 to block the leakage path. Compression of this sort may be included, however. Alternatively, the ring 68 may be formed from a resilient flexible material, such as rubber or a resilient plastics material with elastomeric properties, which may aid in its insertion into the opening 50. Its shape can be distorted or compressed during insertion, and it will then resume its required shape after insertion to maintain the contact between the flared portion 64 and the bore wall. A conventional O-ring might be convenient for use as a ring, for example.

Figure 6:
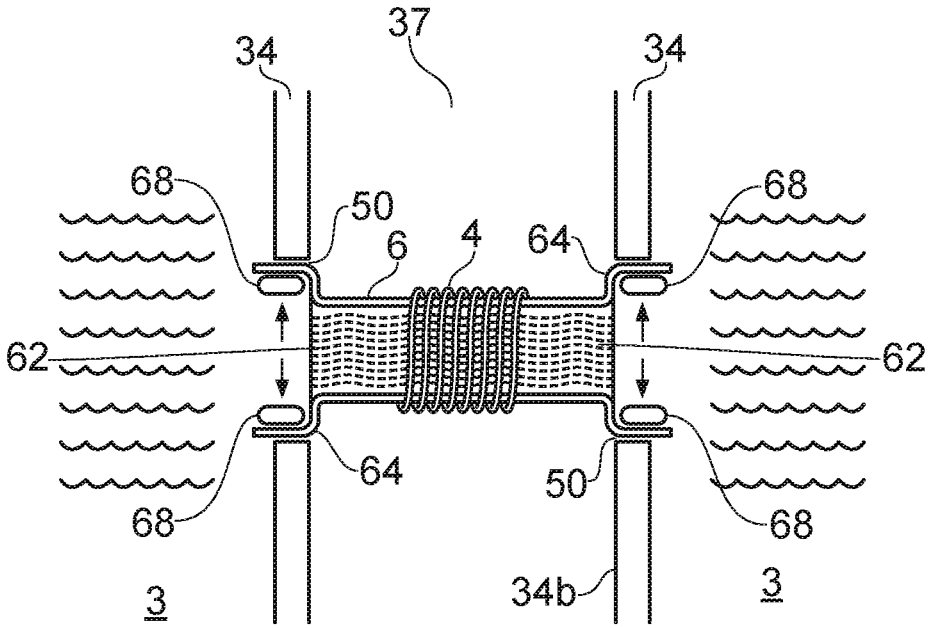

FIG. 6 shows a cross-sectional view of a further example aerosol source, in which a ring is used in a different arrangement to that shown in FIG. 5. Again, a ring 68 is provided which has a central hole and an outer size and shape which at least approximately matches that of the opening 50, and the ring 68 is disposed inside the opening 50, coaxially therewith as before. In this case, however, the wick 6 is not inserted through the central opening of the ring 68. Instead, the ring 68 is inserted inside the flared portion 64, holding it open. The ring therefore rests against an inner surface of the flared portion 64. The flared portion 64 faces forward towards the reservoir interior, and is not curved back towards the heating coil as in the FIG. 5 arrangement. When the ring 68 and the wick 6 are inserted into the opening 50, the flared portion is again pressed between the outside of the ring 68 and the surface of the wall that defines the bore of the opening 50, providing a sealing effect as before since the area of the opening is filled by the flared portion 64, the ring 68 and the end part 62 of the wick 6. If the ring 68 is appropriately sized, and made from a rigid or a resilient material, it will exert a compressive force radially outwards with respect to the wick 6 (shown by the arrows) to hold the flared portion 64 in close contact with the bore wall. If the ring 68 is rigid, the wall 34 may be clamped around it, as noted above for FIG. 5. The end surface of the end part 62 of the wick 6 is aligned more closely with the outer surface 34*b* of the reservoir wall 34 (the surface bounding the air flow passage 37) than with the inner surface 34*a*, so the arrangement differs from the FIG. 5 example in which the end surface of the wick is close to the inner surface 34*a*. Again, the exact position will depend on the thickness of the ring 68 and the position of the ring 68 relative to the depth of the bore of the opening 50 and its position within the flared portion. The end surface of the end part 62 is exposed for absorption of the liquid from the reservoir, but the position of this surface requires the liquid to flow at least partly along the bore of the opening 50 to reach the wick material. The liquid flows through the central opening in the ring 68 to reach the end surface of the end part 62.

Figure 7:
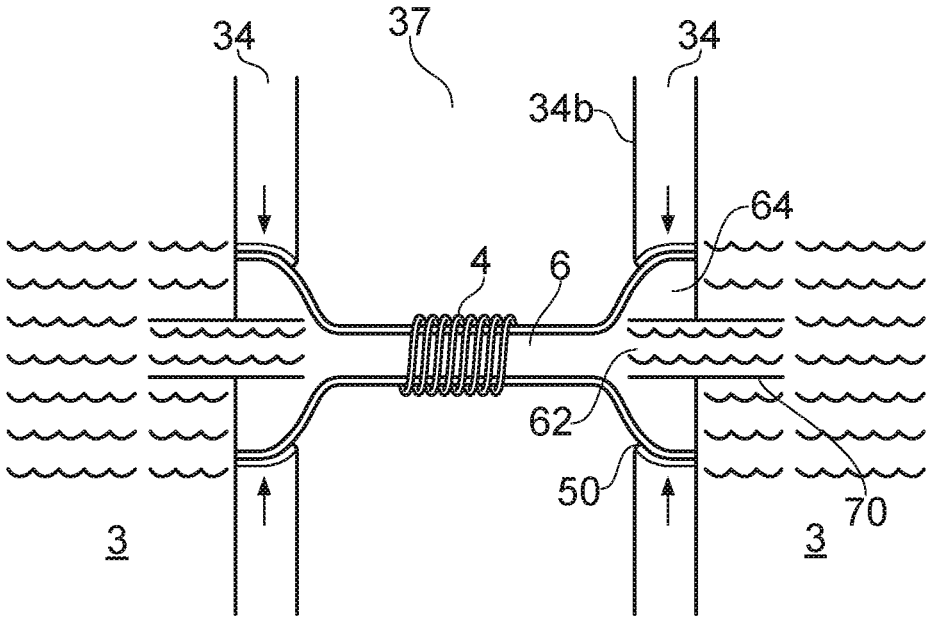

FIG. 7 shows a cross-sectional view of a further example aerosol source having a wick with a flared portion contacting the reservoir wall for sealing. As in previous examples, the end part 62 of a wick 6 is inserted into an opening 50 in the wall 34 of a reservoir 3. Contact is provided between a flared portion 64 of the end part 62 and the inner surface of the wall 34 defining the bore of the opening 50. The cross-section of the wick 6 thus fills the opening 50, providing a seal and inhibiting leakage. The contact is achieved by a plugging element or plug 70 which is inserted into the end surface of the end portion 62 of the wick 6 so that the plug 70 penetrates the wick sufficiently so as to be also inside the bore of the opening 50. The plug 70 is aligned substantially parallel to the longitudinal axis of the wick 6 in this example, and also parallel to the axis of the bore of the opening. The penetration by the plug 70 pushes the surrounding material of the wick 6 radially outwards (to form the flared portion if this has not already been formed by molding or splaying of fibers) and against the surface of the bore wall. The wall 34 therefore provides a compressive force, shown by the arrows, radially inwardly with respect to the wick 6, around the circumference of the opening 50, to give the desired sealing effect. In this example, the wick 6 is inserted into the opening 50 but does not extend into the interior of the reservoir 3, but in other arrangements the wick 6 may reach into the reservoir somewhat. Also, the plug 70 reaches into the wick 6 up to the plane of the outer surface 34*b* of the reservoir wall 34 in this example.

Furthermore, the plug 70 in the FIG. 7 example has the form of a tube or pipe (perhaps formed from a rigid or near-rigid material to provide the required compression and allow easy insertion into the wick 6). Liquid from the reservoir 3 can enter the interior space of the tube and flow along it to reach the material of the end part 62 of the wick, so that liquid is delivered directly into the core of the wick material for efficient absorption and transport to the heating coil 4. This can also help to compensate for any reduced absorption at the end surface of the flared portion 64 surrounding the tube 70, which is exposed to the liquid in the reservoir but may also be compressed such that its porosity is reduced.

Figure 8:
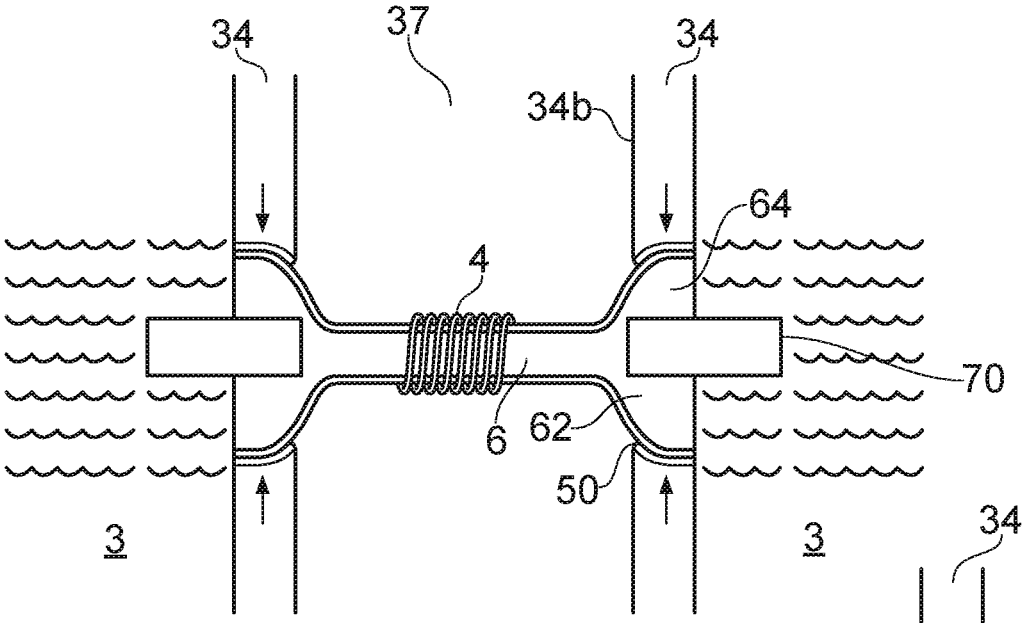

FIG. 8 shows a further example aerosol source in cross-section and similar to the FIG. 7 example, but in which the plug 70 has the form of a solid rod rather than a hollow tube. There is hence no liquid penetration directly into the core of the wick, but if the porosity offered by the surrounding flared portion 64 is adequate for a required level of absorption to supply the heating element, this may be suitable. A solid plug may be advantageous if its non-hollow structure makes insertion into the wick easier.

The FIG. 7 and FIG. 8 examples show openings 50 in the reservoir wall 34 which have a non-uniform bore size. The side walls defining the bore are sloped or curved so that the bore is narrower at the outer surface 34*b* of the wall 34 than at the inner surface 34*a*. In other words, the bore of the opening tapers inwardly in the direction of the liquid flow from the reservoir 3 to the heating element 4. This may give a better match to the shape of the outer surface of the flared portion 64 as it is pushed outwardly by the plug 70, thereby improving the contact and hence giving an enhanced seal. However, the bore need not be shaped in this way.

Similarly, the plug (whether hollow or solid) may have sloped sides to form a tapered, conical or frusto-conical profile such that the plug has a smaller width at the end which is inserted into the wick compared to the end at the reservoir interior. The sloped sides may be straight or curved. Such a shape may facilitate insertion of the plug into the wick material. Also, it can complement any sloped sides walls of the bore as described above, to improve the contact and enhance the seal.

Figure 9:
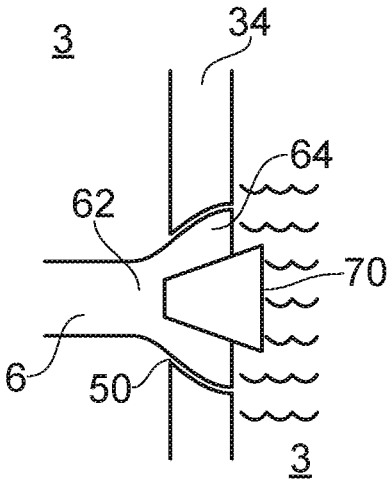

FIG. 9 shows a part of a cross-sectional view similar to the FIG. 8 example, in which the plug has a frusto-conical shape.

Figure 10:
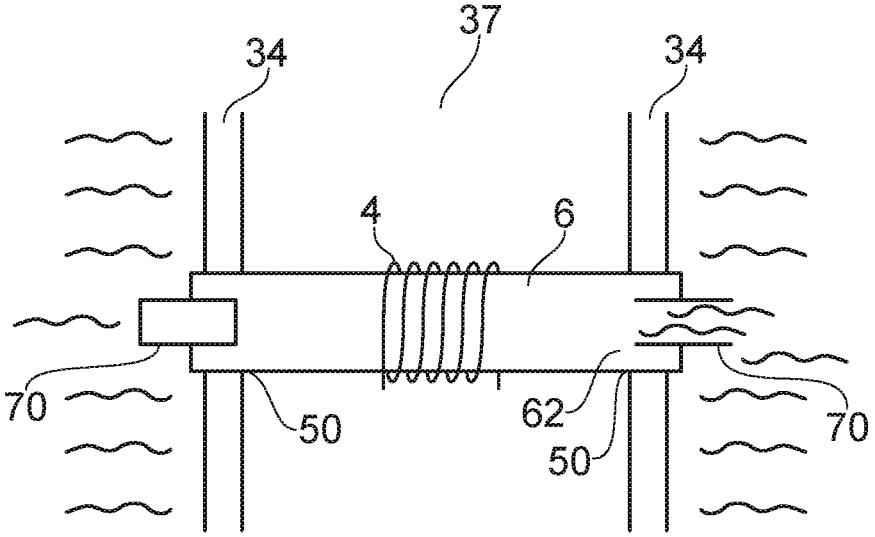

FIG. 10 shows a related example aerosol source in cross-sectional view. As with the FIGS. 7 and 8 examples, a plugging element is inserted into the end of the wick as it extends into or through the opening in the reservoir wall. However, in this case, the wick 6 has a cross-sectional size in the transverse (radial) direction which is approximately the same as the cross-sectional area of the opening, so the insertion of the plugging element does not cause the material at the end part of the wick to flare outwards (i.e. to extend further in the radial direction that the material in the central part of the wick), because it is constrained by the wall of the bore of the opening 50. Rather, the material is compressed against the bore wall only. This ensures contact between the wick 6 and bore wall surface to provide the desired sealing effect. The arrangement might be considered to lack a flared portion at the wick end, however, owing to the lack of outward extension of the wick material. The plug does create a hollow within the wick end, though, so the overall shape and functionality is similar to a more clearly flared arrangement.

As shown at the two ends of the wick 6 in FIG. 10, the plug 70 may comprise a tube or a solid rod as in the FIG. 7 and FIG. 8 examples. A tube might be advantageous as enabling better absorption of liquid into the wick by exposing a larger amount of wick material to the liquid, since the straight sided end portions of the wick offer a smaller end surface of wick material to the reservoir interior compared to the FIGS. 7 and 8 examples where the wick material has space to move sideways when the plug 70 is inserted.

The various examples herein are not intended to be limiting, and other configurations of a flared-end wick in contact with the area at, in or around a reservoir opening to provide a seal can be contemplated.

For example, the reservoir need not be an annular shape surrounding a central airflow passage as in the FIGS. 3 to 10 examples, with two diametrically opposed openings receiving opposite ends of the same wick. Rather, the reservoir may be any convenient shape or size, and may include a different number of openings for receiving one or more ends of one or more wicks. On a related point, the wick need not have two liquid-receiving ends as in the illustrated examples, but may have a single-ended shape with one end associated with a reservoir opening and another portion associated with the vapor generating element. For a wick with more than one end, one or more ends may be provided with a flared portion for sealing contact as described herein, and two ends may use the same or different arrangements to effect the contact. A wick with two ends may be linear as in the illustrated examples, but may be bent or curved such as forming a U-shape.

The illustrated examples include a vapor provision element in the form of a resistive wire heating coil, but any configuration of vapor provision element may be used, including other shapes of resistive wire, other configurations of resistive metal such as embedded heater or a deposited metal layer or trace, electrical heating elements configured for inductive heating, and vapor generating elements that operate without heat, such as vibrating perforated plates and membranes.

A variety of porous materials may be used for a wick or liquid transport element according to the present disclosure.

The material should have an appropriate porosity to provide the required wicking rate (liquid delivery rate) for the source liquid or liquids with which it is envisaged to be used. In some cases a degree of compressibility will enhance the sealing effect where the contact is effected with the aid of a pressing or pushing component (such as the compression members, rings and plugs described above). In these cases the material may therefore be compliant, soft, flexible and/or non-rigid. The wick may be formed from fibers, which are bundled, or twisted or spun into one or more threads, yarns or ropes, which may then themselves be bundled. Also, fibers can be formed into woven and non-woven fabric that can be rolled, twisted or otherwise formed into a wick shape. The fiber may comprise natural materials such as cotton, wool, cellulose or linen, or artificial materials such as various polymers and plastics. Ceramics and glass fibers may also be used. For a fiber-based wick, the flared portion may be form by unravelling and/or splaying the fibers as described with regard to FIGS. 3 and 3A. Alternatively, the wick may comprise a foamed or sponge material (include natural and man-made sponges and foamed ceramics, for example). If the material is sufficiently pliable, the flared portion may form during installation of the wick, such as insertion of a plug into the wick end as in the FIGS. 7, 8 and 9 examples. Otherwise, the flared portion may be specifically formed integrally with the shape of the rest of the wick by a molding, machining or other shaping process. The flared portion may be pliable so as to be bent or folded into a required position, such as being wrapped over a ring in the FIG. 5 example, or the flared portion may be formed to already have its required final "in use" shape.

In conclusion, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other inventions not presently claimed, but which may be claimed in future.

The invention claimed is:

1. An aerosol source for a vapor provision system comprising:

a vapor generating element;

a reservoir for holding source liquid, the reservoir being bounded by a wall having an opening therein; and a liquid transport element for delivering the source liquid from the reservoir to the vapor generating element, the liquid transport element having at least one end part inserted into the opening, the at least one end part having a flared portion arranged in contact with the wall of the reservoir to provide a seal for the opening;

wherein the flared portion is held in contact with a surface of the wall that forms a bore of the opening.

2. The aerosol source according to claim 1, wherein the flared portion is in contact with an inner surface of the wall of the reservoir peripheral to the opening.

3. The aerosol source according to claim 2, further comprising one or more compression members positioned in an interior of the reservoir to press the flared portion against the inner surface of the wall.

4. The aerosol source according to claim 3, wherein the one or more compression members is shaped to press the flared portion against the inner surface of the wall around a complete perimeter of the opening.

5. The aerosol source according to claim 3, wherein the one or more compression members presses the flared portion against the inner surface of the wall at one or more locations spaced apart from an edge of the opening.

6. The aerosol source according to claim 1, further comprising a plugging element penetrating the at least one end part of the liquid transport element along an axis substantially parallel to a longitudinal axis of the bore of the opening so as to press the flared portion against the surface of the wall forming the bore of the opening.

7. The aerosol source according to claim 6, wherein the plugging element comprises a tube through which the source liquid in the reservoir can pass for absorption by the liquid transport element.

8. The aerosol source according to claim 6, wherein the plugging element comprises a solid plug.

9. The aerosol source according to claim 1, further comprising a ring positioned coaxially within the bore of the opening, the flared portion being arranged between the ring and the surface of the wall forming the bore of the opening so as to be pressed against the surface of the wall forming the bore of the opening by the ring.

10. The aerosol source according to claim 9, wherein the liquid transport element extends through the ring, and the flared portion is arranged between the ring and the surface of the wall forming the bore of the opening by curving back over the ring.

11. The aerosol source according to claim 9, wherein the ring is placed inside the flared portion such that the source liquid in the reservoir can pass through the ring for absorption by the liquid transport element.

12. The aerosol source according to claim 1, wherein the liquid transport element is formed from fibers, and the flared portion is formed by outward splaying of the fibers.

13. The aerosol source according to claim 1, wherein the liquid transport element and the flared portion are formed by molding or machining of a material into an intended shape.

14. The aerosol source according to claim 1, wherein the reservoir has two openings, and the liquid transport element has two end parts each with a flared portion, each of the two end parts being inserted into one of the two openings.

15. A vaporizer for a vapor provision system comprising:

a vapor generating element for generating vapor from a liquid; and a liquid transport element for delivering the liquid from a reservoir to the vapor generating element, the liquid transport element having at least one end part inserted into an opening in a wall of the reservoir, the at least one end part having a flared portion arranged in contact with the wall of the reservoir to provide a seal for the opening.

16. A liquid transport element for a vapor provision system, comprising:

a reservoir for holding source liquid, the reservoir including a wall having an opening; and at least one end part insert into the opening, the at least one end part having a flared portion arranged in contact with the wall of the reservoir to provide a seal for the opening.

17. A cartomizer for a vapor provision system comprising the aerosol source according to claim 1.

18. A vapor provision system comprising the aerosol source according to claim 1.

* * * * *